US007878103B2

(12) United States Patent
Imholt et al.

(10) Patent No.: US 7,878,103 B2
(45) Date of Patent: Feb. 1, 2011

(54) SYSTEMS AND METHODS FOR MITIGATING A BLAST WAVE

(75) Inventors: Timothy J. Imholt, Richardson, TX (US); Alexander F. St. Claire, Dallas, TX (US)

(73) Assignee: Raytheon Company, Waltham, MA (US)

( * ) Notice: Subject to any disclaimer, the term of this patent is extended or adjusted under 35 U.S.C. 154(b) by 324 days.

(21) Appl. No.: 12/109,121

(22) Filed: Apr. 24, 2008

(65) Prior Publication Data

US 2010/0319526 A1 Dec. 23, 2010

(51) Int. Cl.
*F41H 13/00* (2006.01)

(52) U.S. Cl. ..... 89/36.08; 89/36.01; 89/1.11

(58) Field of Classification Search ..... 89/36.01, 89/36.02, 36.03, 36.08, 36.04, 1.1, 1.11; 102/303

See application file for complete search history.

(56) References Cited

U.S. PATENT DOCUMENTS 3,893,368 A * 7/1975 Wales, Jr. ..... 89/36.17
3,992,628 A * 11/1976 Karney ..... 250/338.1
4,765,244 A * 8/1988 Spector et al. ..... 102/213
5,134,921 A * 8/1992 Breed et al. ..... 86/50
5,400,688 A * 3/1995 Eninger et al. ..... 89/1.11
6,119,574 A * 9/2000 Burky et al. ..... 89/36.04
6,244,156 B1 * 6/2001 Steuer et al. ..... 89/1.11
6,782,792 B1 * 8/2004 Edberg et al. ..... 89/36.04
6,805,035 B2 * 10/2004 Edberg et al. ..... 89/36.17
6,901,839 B2 * 6/2005 Edberg et al. ..... 89/36.17
7,066,427 B2 * 6/2006 Chang ..... 244/3.19
7,202,809 B1 * 4/2007 Schade et al. ..... 342/67
7,322,268 B1 * 1/2008 Wallin ..... 89/36.17
7,421,936 B2 * 9/2008 Barger et al. ..... 89/36.02
7,437,987 B1 * 10/2008 Ohnstad et al. ..... 89/36.04
7,575,797 B2 * 8/2009 Karr et al. ..... 428/137
2001/0015125 A1 * 8/2001 Poole ..... 89/1.11
2003/0168225 A1 * 9/2003 Denne et al. ..... 169/46
2004/0107827 A1 * 6/2004 Edberg et al. ..... 89/36.04
2004/0118272 A1 * 6/2004 Edberg et al. ..... 89/36.04
2004/0154463 A1 * 8/2004 Edberg et al. ..... 89/36.04
2006/0048667 A1 * 3/2006 Duden et al. ..... 102/501
2006/0107829 A1 * 5/2006 Shumov et al. ..... 89/36.08
2006/0254413 A1 * 11/2006 Yael et al. ..... 89/36.17
2007/0144337 A1 * 6/2007 Zhang et al. ..... 89/36.01
2008/0282876 A1 * 11/2008 Leivesley et al. ..... 89/36.02
2010/0000399 A1 * 1/2010 Barnes et al. ..... 89/36.02

OTHER PUBLICATIONS

M. Cheng, K.C. Hung and O.Y. Chong; article entitled "Numerical Study of Water Mitigation Effects on Blast Wave," Shock Waves (2005) 14(3); pp. 217-223.

J.E. Chisum and Y.S. Shin; article entitled "Explosion Gas Bubbles Near Simple Boundaries," J. Shock Vibration, 4, pp. 11-25, 1997.

* cited by examiner

*Primary Examiner*—Benjamin P Lee
(74) *Attorney, Agent, or Firm*—Baker Botts L.L.P.

(57) ABSTRACT

In accordance with a particular embodiment of the present disclosure, a method to mitigate a blast wave includes detecting an imminent explosion that produces a blast wave. In response to this detection, the energy of a portion of this blast wave may be reduced by deploying a fluid in the path of the blast wave.

24 Claims, 4 Drawing Sheets

SYSTEMS AND METHODS FOR MITIGATING A BLAST WAVE

TECHNICAL FIELD

The present invention relates generally to mitigating a blast wave, and in particular reducing the energy of a blast wave using a fluid.

BACKGROUND

Explosions are dangerous not only because of the shrapnel that may be thrown from the explosion, but also because of the blast wave an explosion generates. The more powerful the explosion the more damaging the blast wave. Blast waves may damage equipment and harm individuals because of the severe pressure differentials that are experienced over an extremely short period of time. In certain explosions, normal atmospheric pressure may rise to over 100 psi and then drop to below −20 psi in less than 2500 microseconds. Under these conditions, severe injury to ears, eyes, and lungs may result.

In certain defense applications, an approximate time of detonation and location of an explosion may be known. For example, a rocket propelled grenade may be intercepted by a rocket fired from a defense system at a relatively safe distance from equipment and personnel. The location and the time of this explosion may therefore be predictable. Although this explosion may occur at a safe distance such that shrapnel may not be propelled far enough to cause significant damage, the blast wave created by this explosion may nevertheless inflict damage to equipment and injury or even death to individuals.

SUMMARY

In accordance with a particular embodiment of the present disclosure, a method to mitigate a blast wave includes detecting an imminent explosion that produces a blast wave. In response to this detection, the energy of a portion of this blast wave may be reduced by deploying a fluid in the path of the blast wave.

Technical advantages of particular embodiments of the present disclosure may include a deployment of a fluid that may absorb energy and reduce the pressure of a blast wave. An individual experiencing a blast wave with reduced energy may incur less severe injuries, if any at all.

Yet further technical advantages of particular embodiments of the present disclosure may include a lightweight and easily replaced medium for absorbing energy of a blast wave.

Even further technical advantages of particular embodiments of the present disclosure may include temporary deployment of a fluid medium to protect equipment and individuals from blast waves. Such temporary deployment may reduce the amount of armor required to be permanently installed on a battlefield vehicle.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of the present embodiments and advantages thereof may be acquired by referring to the following description, taken in conjunction with the accompanying drawings wherein.

DETAILED DESCRIPTION

Particular embodiments of the disclosure and their advantages are best understood by reference to FIGS. 1-4.

Figure 1:
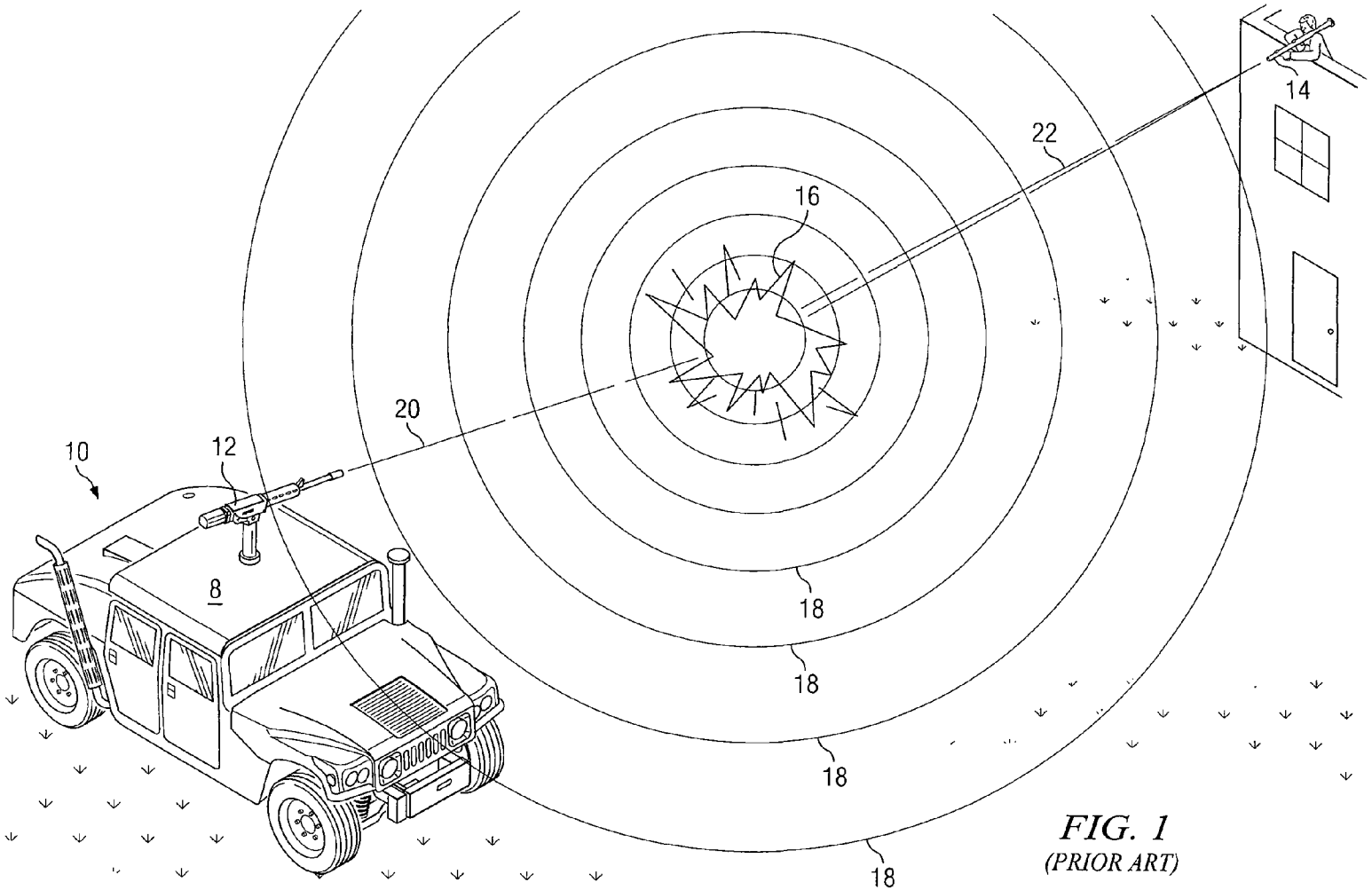
FIG. 1 (PRIOR ART)
FIG. 1 illustrates a battlefield scene that may be observed when a rocket propelled grenade is intercepted by a projectile.

FIG. 1 illustrates a scene that may be observed on a battlefield. Vehicle 8 may be a target of an individual with a rocket propelled grenade launcher ("RPG") 14. Active Protection System ("APS") 10 may protect vehicle 8 from the grenade launched by RPG 14. Active Protection System 10 may include a rocket launcher 12. Upon detection of the incoming grenade by APS 10, rocket launcher 12 may launch a small rocket towards the incoming grenade launched from RPG 14. The rocket may travel along rocket path 20 and intercept the grenade traveling along grenade path 22 at a relatively safe distance from vehicle 8. When the rocket launched from APS 12 hits the grenade launched from RPG 14 an explosion 16 may be created. Explosion 16 may occur approximately meters, for example, away from vehicle 8. It may destroy the grenade and provide some protection for vehicle 8 and its occupants.

However, even though explosion 16 may occur a relatively safe distance of 10 meters away from vehicle 8 and its occupants, it may still create blast wave 18, which may still inflict damage to vehicle 8 and injure its occupants.

Explosion 16 may be dangerous due to blast wave 18 that may be produced. Explosion 16 may create a large amount of energy that may be released in a very small volume. When this occurs air nearby explosion 16 may compress rapidly. This compressed and condensed air may expand outward at a very high speed. The expansion of this air away from the explosion 16 may be described as the blast wave or shock wave and is illustrated by concentric circles in FIGS. 1 and 2A. Blast wave 18 may comprise the initial shock or blast wave 18, which may be followed by a region of underpressure.

When an explosive detonates and an explosion such as explosion 16 occurs, a large amount of energy is imparted into compressing the air in the immediate vicinity. This compression forms the basis for the first phase of blast wave 18, the overpressure phase.

This compression puts the air in an overpressure state, which may be dangerous. When the human body is subjected to an overpressure of approximately 5 psi the ear drums may rupture. Above 50 psi, other organs, particularly the lungs, may become severely damaged.

Often times, shock waves from explosions can compress air to pressures well above 100 psi, resulting in immediate death.

The compressed air of the blast wave 18 materializes from the region following the shock wave. This region is therefore lacking in air, resulting in underpressure. Both the overpressure phase and the underpressure phase may occur over 5 to 10 thousand microseconds.

Underpressure can be just as dangerous and cause just as severe injury as overpressure. For example, severe underpressure occurring over a fraction of a second may rupture an eardrum due to the air rushing out of the ear. Likewise, blood vessels in the brain and lungs may also explode outwards causing concussions and potentially even death. Fluid in the eyes may even burst outwards, causing blindness. Similar effects occur with the severe overpressure. However, in the overpressure state, instead of gas and fluid exploding outwards, they are crushed inwards. For example, the blood vessels in the lungs may collapse and restrict oxygen flow to the rest of the body.

Any exposed fluid/gas organ will be most susceptible to damage. Three of the primary pressure injuries occur at the ears, eyes, and lungs. Both underpressure and overpressure may cause similar primary injuries that include ear drum ruptures, lung damage, and blindness. Additional injuries may also occur, such as loss of consciousness, central nervous system damage, and death. Blast waves for many military munitions contain both overpressure and underpressure regions, both of which can inflict massive injury to a human.

Figure 2A:
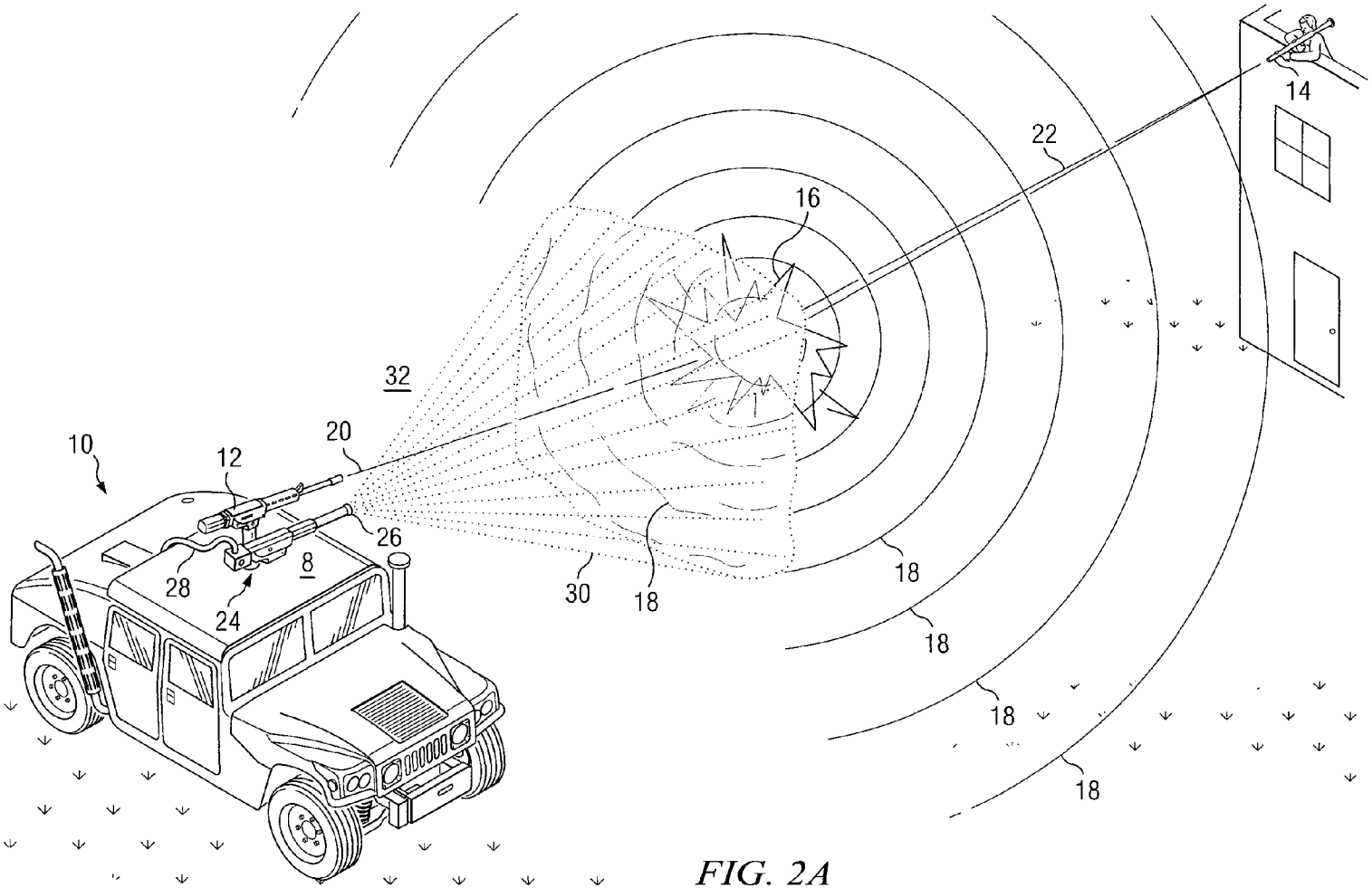
FIG. 2A illustrates a similar battlefield scene as FIG. 1 but with a fluid being deployed to mitigate a blast wave in accordance with an embodiment of the present disclosure.

FIG. 2A illustrates a battle scene similar to the illustration in FIG. 1. However, vehicle 8 of FIG. 2A is shown equipped with a fluid launching device 24 according to an embodiment of the present disclosure. Fluid 30 may be temporarily deployed from fluid launching device 24 in anticipation of explosion 16 and blast wave 18. A sheet of fluid 30 may be deployed to create a zone of protection 32. Fluid launching device 24 may include nozzle 26. Nozzle 26 may allow fluid 30 to be launched from fluid launching device 24 in a variety of configurations. For example, fluid 30 may be in the form of a mist or may be in the form of a wall of fluid. Fluid launching device 24 may also include hose 28. Hose 28 may connect fluid launching device 24 to a reservoir of fluid. The fluid launched by fluid launching device may be a liquid. In particular, the fluid may be water, ethylene glycol, or any other suitable liquid.

Figure 2B:
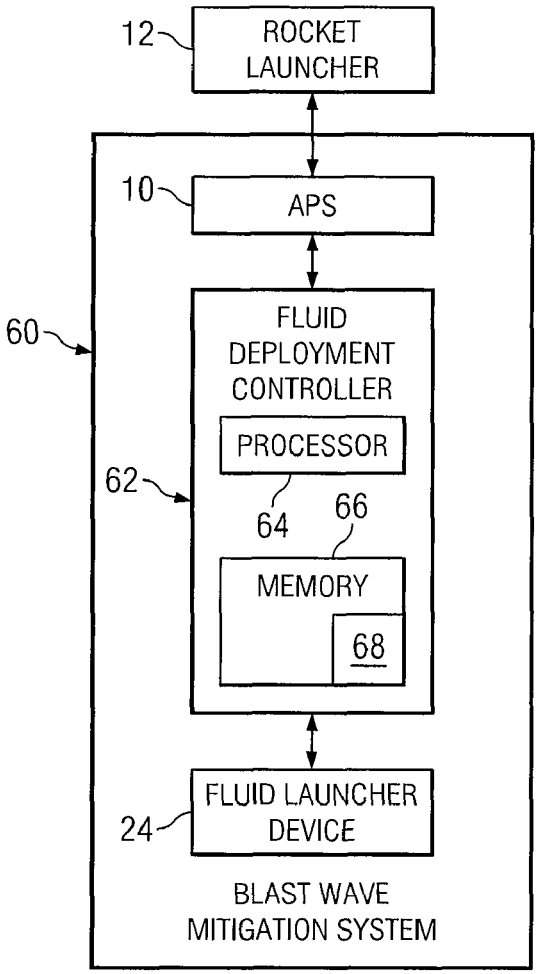
FIG. 2B illustrates a block diagram of a blast wave mitigation system that may be used to initiate the deployment of fluid in accordance with an embodiment of the present disclosure.

FIG. 2B is a block diagram illustrating blast wave mitigation system 60 that may be used to initiate the deployment of fluid 30 in accordance with an embodiment of the present disclosure. Blast wave mitigation system may include active protection system 10, fluid deployment controller 62, and fluid launching device 24.

The components of blast wave mitigation system 60 may work together to allow detection of an incoming projectile, deployment of munitions to intercept the projectile, and the temporary deployment of a fluid to reduce the energy of a blast wave that may be created by the destruction of the projectile. Blast wave mitigation system 60 may be a single device or may be incorporated into other devices and/or its components may be spread among several devices and systems.

Fluid deployment controller 62 may be any suitable hardware, software, or combination thereof that provides functionality to allow deployment of a fluid at a suitable time and in a suitable form to reduce the energy of a blast wave. Fluid deployment controller 62 may be an application specific integrated circuit, or any other suitable computing device, resource, or combination of hardware, software and/or encoded logic operable to provide, either alone or in conjunction with other components of fluid blast wave mitigation system 60 the above stated functionality. In the illustrated embodiment, fluid deployment controller 62 includes memory 66 and one or more processors 64. Memory may include fluid deployment application 68.

Blast wave mitigation system may provide functionality discussed herein. For example, application protection system 10 may receive information regarding the detection and tracking of an incoming projectile. Suitable sensors and/or a radar systems that are part of APS 10 or are remote to APS 10 may receive this information. Application Protection system 10 may compute a distance, direction and speed of the incoming projectile. This information may be used by rocket launcher 12 to determine the proper timing and trajectory to deploy one or more precision counter munitions to intercept the incoming projectile.

In addition to processing the information to allow the deployment of the precision munitions, blast wave mitigation system 60 may use the detection and tracking information to determine the timing and location of explosion 16 that may be created when the precision counter munitions intercept the incoming projectile.

Fluid deployment controller may receive this information regarding explosion 16 and processor 64 may determine a location and timing for the deployment of fluid 30. Fluid deployment application 68 which may be stored in memory 66 may direct fluid launching device 24 to launch fluid 30 such that fluid 30 may receive part of the blast wave created by the explosion 16. Processor 64 may determine a time to deploy fluid 30 such that it is in such a location at such a time that it may receive a portion of blast wave 18 and reduce its energy.

Memory 66 may be any form of volatile or non-volatile memory including, without limitation, magnetic media, optical media, random access memory (RAM), read-only memory (ROM), removable media, or any other suitable local or remote memory component. Memory 66 may a variety of programs and information. For example, memory 66 may store fluid deployment application 68.

Figure 2C:
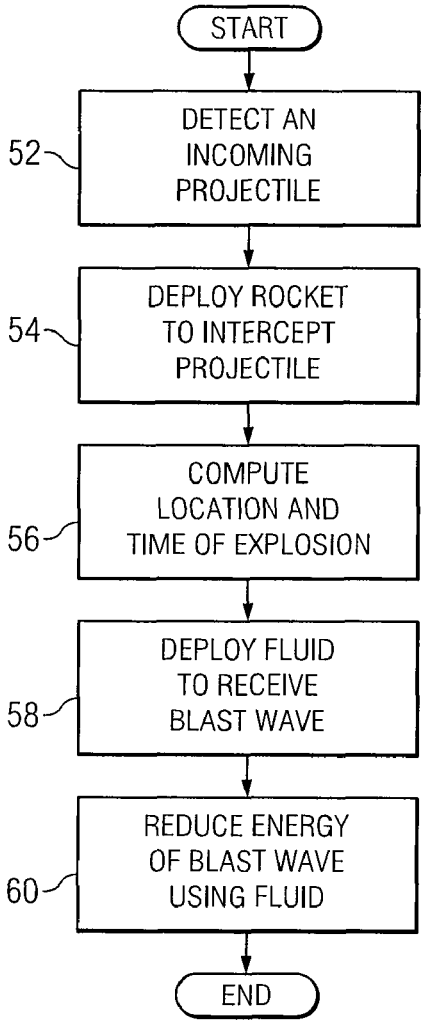
FIG. 2C is a flow diagram of a method of reducing the energy of a blast wave using a fluid in accordance with an embodiment of the present disclosure.

FIG. 2C illustrates a flow diagram of a method to temporarily deploy a fluid that may receive and reduce the energy of blast wave 18. Blast wave mitigation system 60 may control devices that are operable to perform the functions of the method. The method begins at step 52 where Active Protection System 10 may detect an incoming grenade or other projectile. In response to this detection, at step 54, a rocket may be deployed by rocket launcher 12 and travel on rocket path 20 to intercept a grenade launched from RPG launcher 14. Blast wave mitigation system 60 may determine the distance, direction, and speed of the grenade and also the direction, distance and speed of the rocket to determine a location and a time of explosion 16 at step 56. Having determined the approximate location and time of an imminent explosion, fluid deployment application 68 may direct fluid launching device 24 to deploy fluid 30 at a suitable time, location, and configuration to allow it to receive a portion of blast wave 18 at step 58. Fluid 30 may receive a portion of the blast wave and reduce its energy in accordance with an embodiment of the present disclosure at step 60, ending the method.

Fluid 30 may receive a portion of blast wave 18 and reduce its energy creating zone of protection 32 behind fluid 30. Zone of protection 32 may be created because the portion of blast wave 18 that must pass through fluid 30 may lose some of its energy. Thus, zone of protection 32 may experience a blast wave with less energy to damage vehicle 8 or injure its occupants.

In certain embodiments, fluid 30 may be cooled. Cooling fluid 30 may allow more heat energy to transfer from blast wave 18 to fluid 30, thereby reducing even further the energy of blast wave 18 that reaches protection zone 32.

Fluid 30 may mitigate the energy of blast wave 18 by absorbing a portion of its energy. Blast wave 18 may aerosolize fluid 30. When aerosolization occurs, fluid 30 may break into many very tiny droplets. These droplets may increase the total surface area between fluid 30 and the air. Heat exchange may occur through the surface area boundary between fluid 30 and the air. By increasing this surface area through aerosolizing the fluid, the rate of heat exchange may rise significantly. Since blast wave 18 has a very large amount of energy, it imparts energy into the water through this heat exchange. Fluid 30 may undergo a phase change as the heat energy from blast wave causes fluid 30 to transform into a gas. Concurrently, there may be a reduction of energy in blast wave 18 as that energy causes the phase change in fluid 30. This exchange in energy may reduce the temperature of blast wave 18, and thus lower its pressure. In addition to absorbing part of the heat energy of blast wave 18, fluid 30 may also serve to divert a portion of blast wave 18. A parabolic configuration of fluid sheet 30 may serve to further deflect portions of blast wave 18 and may provide increased protection to individuals and equipment in zone of protection 32.

Launching fluid 30 to absorb the energy of blast wave 18 may be more convenient and less costly than shielding with a piece of armor. Also, once fluid 30 has served its function of reducing the energy of blast wave 18, it essentially disappears and is not an obstacle which an individual must stay behind or look over or around. Because protection is only required for a short period of time to protect against blast wave 18, only a small amount of water may be needed. Moreover, using fluid 30 as a protection system may also allow a lightweight solution and that is readily available to mitigate destructive blast wave energy. Refilling a reservoir with fluid 30 may be an easy operation and may avoid having to carry expensive, heavy, and permanent armor.

Because the rate at which heat is exchanged from blast wave 18 to fluid 30 is based upon differences in temperature, cooling fluid 30 may increase the temperature differential, and thus increase the rate of heat exchange. This may allow a greater amount of energy to be absorbed from blast wave 18 and a greater reduction in pressure.

Any fluid that may be aerosolized by blast wave 18 may be used in accordance with an embodiment of the present disclosure. Fluid 30 may be selected based upon its heat of vaporization. A fluid with a higher heat of vaporization may require more energy to convert it from a liquid to a gas. Thus, fluid 30 with a higher heat of vaporization may be more effective at mitigating blast wave 18 than a fluid having a lower heat of vaporization. In certain embodiments, fluid 30 may be replaced by a powder substance that may be capable of absorbing more of the heat energy of blast wave 18 than a fluid.

Blast wave 30 may move spherically from the location of explosion 16. Fluid 30 may be launched in a direction perpendicular to the movement of blast wave 30. In alternate embodiments, fluid 30 may be launched away from the direction of movement of blast wave 18. In addition, multiple fluid 30 streams may be launched in multiple different directions. Also, multiple sheets of fluid 30 may be oriented one behind the other. Once blast wave 18 moves through a first sheet of fluid 30 its energy may be reduced. When what is remaining of blast wave 18 reaches a second sheet of fluid 30, its energy may be even further reduced providing greater protection for the equipment and individuals located in zone of protection 32.

The following formula represents the percent peak reduction of a blast wave's energy when an explosive encased in water is detonated:

$$\text{Peak Reduction} = 100 - \left(60.2e^{-0.4489\frac{W}{T}} + 39.5\right) \quad \text{(I)}$$

M. Cheng et al., *Numerical Study of Water Mitigation Effects on Blast Wave*, Shock Waves, Vol. 13 No. 3, 2005. In the formula, W is the weight of water, T is the weight of an explosive composed of Trinitrotoluene (TNT).

This equation may be applied to model a system where a wall of fluid absorbs a portion of a blast wave. For example, applying the equation to a fluid wall that is one foot by one foot square and has a thickness of 0.1 inches and applying a safety factor of two, it can be estimated, that a hemispherical explosion that occurs approximately three feet from the fluid wall may have its blast wave energy reduced approximately 44%. This calculation takes into consideration that the reduction of peak pressure equation (I) applies to water absorbing an entire blast wave because the water encases the explosive. The equation may be modified to geometrically determine a fraction of the blast wave that may be received by the wall of fluid. Also, the equation may be modified to account for an explosion of C4 explosive as opposed to TNT. C4 may be 1.34 times as explosive as TNT.

Figure 3:
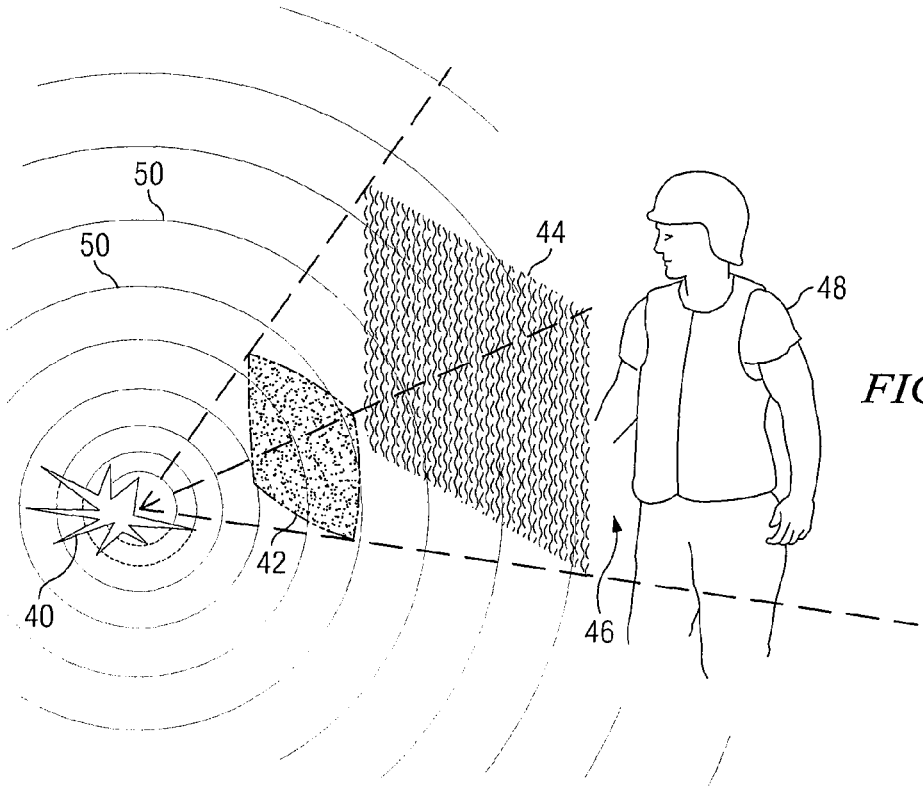
FIG. 3 is a diagram showing a fluid wall and a portion of a blast wave that may be received by the fluid wall in accordance with an embodiment of the present disclosure.

FIG. 3 illustrates schematically a portion of a blast wave 50 that may be absorbed by fluid wall 44. Explosion 40 may occur in front of fluid wall 44. Explosion 40 may create blast wave 50 indicated in FIG. 2 by concentric arcs emanating from explosion 40. Blast wave portion 42 may be a graphical representation of the portion of the blast wave that may be received by fluid wall 44. Fluid wall 44 may create a zone of protection 46 by absorbing energy from the blast wave in accordance with the teachings of the present disclosure. Individual 48 in zone of protection 46 may experience a blast wave with reduced energy resulting in less severe or no injuries. Fluid wall 44 may have a variety of thicknesses. For example, in one embodiment fluid wall 44 may have a thickness of 0.1 inches. In other embodiments, fluid wall 44 may have a thickness from 0.05 inches to 0.2 inches. However, any suitable thickness of fluid wall 44 may be created. In certain embodiments, a fluid wall with a thickness that is less than 0.05 inches may be used. In other embodiments, when mitigating the blast wave from a very large explosion, a fluid wall of greater than 0.2 inches may provide greater reduction in the blast wave's energy. Moreover, the configuration of fluid wall 44 may be tailored to meet the desired goal.

Figure 4:
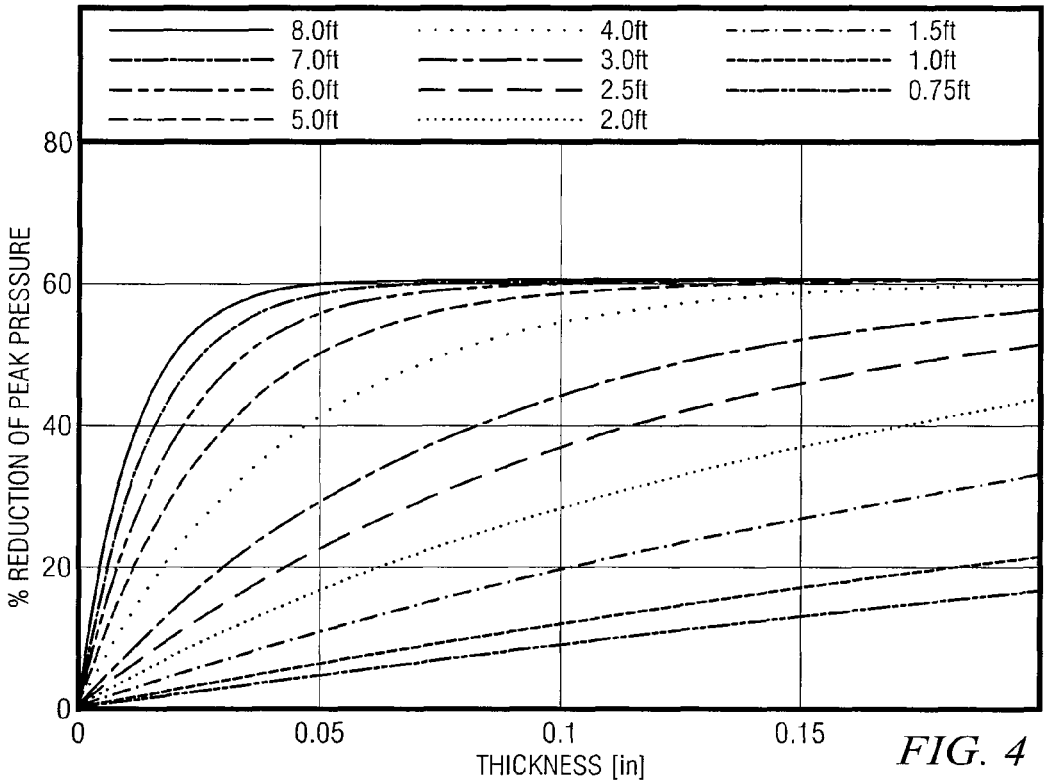
FIG. 4 illustrates a graph of percent reduction of a blast wave's peak pressure versus thickness of a fluid wall in accordance with an embodiment of the present disclosure.

FIG. 4 illustrates the percent reduction of peak pressure of an explosive versus a thickness of a wall of water. The graph is plotted for a number of different distances that the wall of water may be placed from the point of explosion. An asymptote of 60.2% is shown. The decreasing reduction in peak pressure as the wall of water moves closer to the explosive can be seen. This may be because a water wall that is further away from an explosive may receive less of the blast wave.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A method to mitigate a blast wave, comprising:

deploying, by a projectile launching device, an outgoing projectile to intercept an incoming projectile;

detecting, by a fluid deployment controller, an imminent explosion from a collision of the deployed outgoing projectile with the incoming projectile, the explosion operable to produce a blast wave; and reducing an energy of a portion of the blast wave by deploying, by a fluid launching device and in response to the detection, a fluid in a path of the blast wave.

2. The method of claim 1, wherein the fluid comprises water.

3. The method of claim 2, wherein the fluid comprises water cooled below an ambient temperature of air in an area of the blast wave.

4. The method of claim 1, wherein deploying the fluid further comprises deploying a sheet of water.

5. The method of claim 4, wherein a thickness of the sheet of water is greater than or equal to 0.05 inches and less than or equal to 0.2 inches.

6. The method of claim 1, wherein deploying the fluid further comprises deploying a mist of water.

7. The method of claim 1, further comprising reducing the energy of at least a portion of the blast wave by converting the fluid into an aerosol.

8. The method of claim 7, wherein reducing the energy of the portion of the blast wave comprises reducing the energy at least 20 percent.

9. The method of claim 1, wherein the fluid comprises ethylene glycol.

10. The method of claim 1, wherein deploying the fluid comprises launching the fluid from a hose.

11. A system for mitigating a blast wave, comprising:

a fluid deployment controller operable to perform operations comprising:

receiving information about an incoming projectile; and calculating an approximate time to deploy a fluid such that the fluid is in a path of a blast wave created by an outgoing projectile destroying the incoming projectile; and a fluid launching device operable to deploy the fluid in the path of the blast wave, the fluid operable to reduce an energy of the blast wave created by the outgoing projectile destroying the incoming projectile, and a projectile launching device operable to launch the outgoing projectile toward the incoming projectile, the impact of the outgoing projectile with the incoming projectile creating an explosion that creates the blast wave.

12. The system of claim 11, further comprising:

a vehicle coupled to the fluid launching device; and a projectile launching device coupled to the vehicle, the projectile launching device operable to deploy an outgoing projectile.

13. The system of claim 12, wherein the fluid launching device comprises a nozzle operable to create a sheet of the fluid.

14. The system of claim 11, further comprising a reservoir operable to contain the fluid.

15. The system of claim 11, further comprising a cooling device coupled to the reservoir, the cooling device operable to cool the fluid.

16. The system of claim 11, wherein the fluid deployment controller is further operable to compute an approximate time and location of the explosion.

17. A method for mitigating a blast wave, comprising:

receiving, by a fluid deployment controller, information about an incoming projectile;

deploying, by a projectile launching device, an outgoing projectile to destroy the incoming projectile;

calculating, by the fluid deployment controller, an approximate time to deploy a fluid such that the fluid is in a path of a blast wave created by destroying the incoming projectile; and deploying, by a fluid launching device, the fluid in the path of the blast wave created by destroying the incoming projectile, the fluid operable to reduce an energy of the blast wave.

18. The method of claim 17, wherein the fluid comprises water.

19. The method of claim 17, wherein the fluid comprises water cooled below an ambient temperature of air in an area of the blast wave.

20. The method of claim 17, wherein deploying the fluid further comprises deploying a sheet of water.

21. The method of claim 20, wherein a thickness of the sheet of water is greater than or equal to 0.05 inches and less than or equal to 0.2 inches.

22. The method of claim 17, wherein deploying the fluid further comprises deploying a mist of water.

23. The method of claim 17, further comprising reducing the energy of at least a portion of the blast wave by converting the fluid into an aerosol.

24. The method of claim 17, wherein the fluid comprises ethylene glycol.

* * * * *